United States Patent [19]

Swinehart et al.

[11] 4,088,560

[45] May 9, 1978

[54] DEVICE FOR HOLDING AND MASKING POST-TYPE EARRINGS DURING THE COATING THEREOF

[75] Inventors: Robert L. Swinehart, Warwick; Paul N. Patrick, Cranston, both of R.I.

[73] Assignee: P.N. Patrick Company, Inc., Providence, R.I.

[21] Appl. No.: 779,708

[22] Filed: Mar. 21, 1977

[51] Int. Cl.[2] ..... C25D 17/08

[52] U.S. Cl. ..... 204/297 W

[58] Field of Search ..... 204/281, 297 R, 297 W, 204/297 M

[56] References Cited

U.S. PATENT DOCUMENTS

| | | | |
|---|---|---|---|
| 2,916,431 | 12/1959 | O'Connor | 204/297 W |
| 3,001,926 | 9/1961 | Belke | 204/297 W |
| 3,039,951 | 6/1962 | Clenard et al. | 205/297 W |
| 4,014,778 | 3/1977 | Harrison | 204/297 W |

OTHER PUBLICATIONS

Plating Rack Manual by Belke p. 24, plate 12, plate 18, pub. by Belke Mfg. Co., Chicago, 1947.

*Primary Examiner*—F.C. Edmundson
*Attorney, Agent, or Firm*—Robert J. Doherty

[57] ABSTRACT

A device for holding a post-type earring during its receipt of an ornamental coating as by electrolytic deposition including a body having electrically conductive insert positioned therein, which insert includes an internal chamber with which aligned openings in the insert and body communicate. A resilient plug having an elongated bore is positioned within the body opening for receipt of the post of a post-type earring to mask the same from receiving an ornamental coating. Lower portions of the post project into the chamber and spring means are further included therein for assuring that electrical contact is made between the insert and the earring.

8 Claims, 6 Drawing Figures

DEVICE FOR HOLDING AND MASKING POST-TYPE EARRINGS DURING THE COATING THEREOF

BACKGROUND OF THE INVENTION

This invention relates to a holding device for post-type earrings. Such earrings include an ornamental portion and a post generally in the form of a cylindrical rod or pin normally extending from the rear surface of such ornamental portion and adapted to pass through a pierced ear opening in the lobe of an earring wearer. The ornamental portion of the earring may be formed from any suitable material in order to achieve the desired ornamental effect and may include a bezel or setting for stones and other decorative materials and the like. The post, however is generally formed from a stainless type steel such as surgical steel in order that the post upon movement within and contact with the pierced ear opening will not cause infection, discoloration etc. thereof. Such materials are generally referred to as "super-allergenic materials". Also, as is known, a keeper or clutch element is utilized to receive the end of the post or pin projecting through the pierced ear opening so as to assure its positioning with regard to the wearer's ear.

Generally it is common to plate, coat or otherwise form a decorative metal surface as by electrolytic deposition upon at least portions of the earring ornament. It is also likely that during such coating procedures, portions of the pin which come in contact with the pierced ear opening may undesirably receive such coatings. It is accordingly desirable to be able to mask those portions of the pin or post which will come in contact with the pierced ear opening so as to assure that such areas do not receive a coating and thus maintain their super-allergenic condition.

It is also essential that during the commonly utilized electrolytic deposition of such decorative coating that electrical contact be maintained between the earring and the means which is utilized to support such in the bath or dip tank. Such means normally takes the form of some type of rack or device from which a plurality of earrings are affixed as by clamps and the like to assure electrical contact and then the total assembly lowered into the plating tank. It is accordingly further desirable that electrical contact be maintained between the earring and its supporting means during the plating procedure in addition to assuring that those areas of the post which will contact the pierced ear opening are masked from receiving such coating.

SUMMARY OF THE INVENTION

The present invention fulfills the above indicated needs through the provision of a holding device generally including a non-electrically conductive body having an electrically conductive insert positioned therein. The insert further includes a chamber and an opening communicating therewith both of which are aligned with a further opening in the body itself. The body opening is adapted to receive a plug of resilient material having elongated bore also aligned with the insert and body openings so as to receive in sealing engagement a portion of the post of a post-type earring so as to effectively mask those portions within the plug and those portions thereof extending therebelow into the insert chamber from receiving a coating during the electrolytic deposition thereof. Furthermore, electrically conductive spring means are positioned within the chamber so as to assure electrical contact is maintained between the post and accordingly the earring itself and the insert.

It is accordingly a primary object of the present invention to provide a device for holding post-type earrings during the receipt of coatings on portions thereof, which device effectively masks those portions which will come in contact with the pierced ear opening of an earring wearer from receipt of such coatings in an inexpensive and straightforward manner which further does not necessitate any changes in post-type earring constructions.

A further object of the present invention is the provision of a device for holding post-type earrings during their receipt of decorative coatings on portions thereof by electrolytic deposition wherein such means assures, in addition to masking portions of the post from receipt of such coating, that a continual electrical current may be provided to the earring.

A still further object of the present invention is the provision of a device for holding post-type earrings in which the device is so constructed so as not to accept plated coatings thereon during its use in contact with electrolytic deposition solutions.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
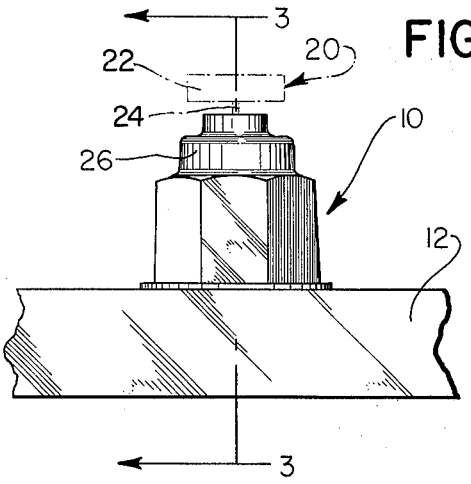
FIG. 1 is a view of one device incorporating features of the present invention's positioned on a support or bar of the type which would be utilized to suspend a plurality of such devices within an electrolytic coating solution.
Figure 2:
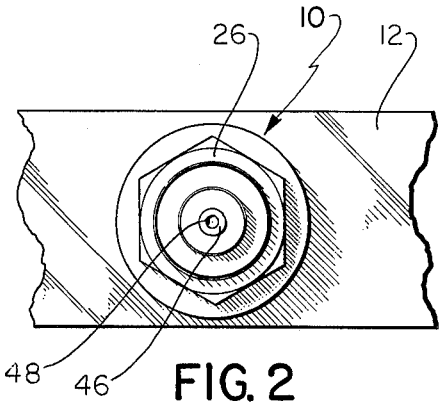
FIG. 2 is a plan view thereof.

The holding device 10 of the present invention is, as shown in FIG. 1 of the drawing, adapted for positioning on a bar or support 12. Generally a bar includes a plurality of such devices according to the number of earrings to be coated. After the earrings are positioned, the bar is lowered within the plating solution of an electrolytic dip tank and after the earrings are coated, the bar withdrawn and the earrings further processed. While the present invention will be illustrated and described with particular regard to electrolytic coating deposition, it should be brought out that other coating techniques such as painting or spraying which may or may not require a flow of electrical current to the earring are also contemplated and included within the present invention.

Figure 4:
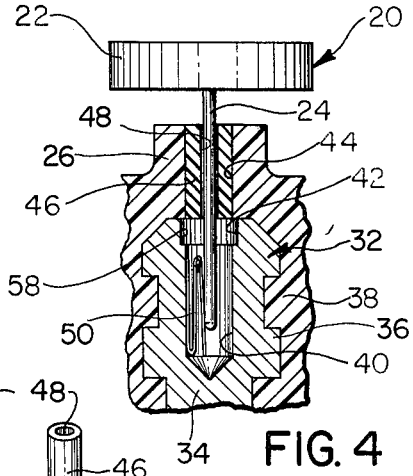
FIG. 4 is a partial sectional view on an enlarged scale and showing in particular the manner in which electrical contact is maintained between the support and earring.

The bar 12 normally includes a metal shaft 14 and a surrounding outer layer 16 formed of a non-conductive material including plastic resins. The bar 12 is drilled and tapped to form a plurality of threaded openings 18 at spaced longitudinal distances in such a manner so as to receive a plurality of the holding devices 10 as aforementioned. As best indicated by FIG. 4 of the drawing, the post-type earring 20 generally includes an ornamental portion 22 and a post or pin 24 projecting outwardly at right angles from the rear surface thereof. The pin may be attached to the ornament 22 in any suitable fashion including welding, soldering, brazing and the like and is normally formed of a super-allergenic material such as surgical or stainless steel in order to assure that when worn within the pierced ear opening of an earring wearer that infection, discoloration or other undesirable effects will not be caused thereby. It is accordingly necessary that those portions of the post 24 which are most apt to contact the pierced ear opening are maintained free from receiving a coating of material which, although decorative and useful when applied to the ornamental portion 22, may well be harmful from an allergenic standpoint.

The device 10 includes an outer body 26 preferably formed as previously indicated of a non-conductive resinous plastic composition such as polyethylene, polypropylene or copolymers thereof. The body 26 is generally of a cap-shaped configuration and includes a lower flanged terminus 28 which may include one or more downwardly projecting concentric rings 30 which are adapted to more positively seal or contact with the surface coating 16. The body is further provided with an internal insert 32 of a conductive metal such as copper or copper alloys and in turn having a downwardly extending threaded post 34 adapted for mounting within the openings 18 of the bar 12. Inasmuch as the insert 32 is positively fixed with relationship to its position within the body 26, positioning of the insert 32 positions the entire assembly 10. Furthermore, such body-insert interconnection may be effected by means of a snapfit relationship between cooperating projecting flanges 36 and 38 of the body and insert 26,32 respectively or alternatively the body may be formed by known injection molding techniques in situ about the insert and accordingly be permanently assembled therewith.

Figure 3:
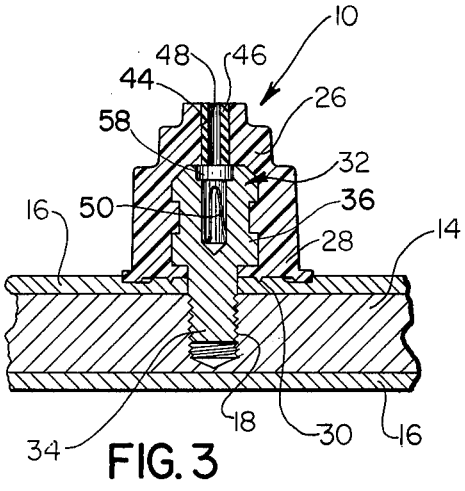
FIG. 3 is a side sectional view taken along the line 3—3 of FIG. 1.

The insert 32 is further provided with a generally cylindrical internal chamber or bore 40 as shown in FIGS. 3 and 4. The chamber communicates with an opening 42 adjacent thereto and positioned on the top of the insert which in turn communicates with an opening 44 provided through the top portion of the body 26 and in turn aligned with the opening 42 and chamber 40. The body opening 44 is adapted to receive a plug 46 of resilient material such as rubber and plastic resin compositions which in turn is provided with an elongated bore 48 also aligned with the openings 44 and 42 and the chamber 40. The thickness of the bore 48 is such that the post 24 may be firmly received thereby and resiliently positioned with respect to the device 10 as illustrated in FIG. 4. In this position most of the portions of the post 24 are masked from receiving a coating as by their positioning within the resilient plug 46 or projecting therebelow into the opening 42 and chamber 40.

In those cases where the coating is deposited by electrolytic means and accordingly requires that electrical contact be maintained to the earring 20, an electrically conductive metal spring 50 of generally S-shaped configuration is positioned within the chamber 40. This spring includes a first elongated arm 52, a reversely bent intermediate section 54, and a foreshortened second or base arm 56. The longer or first arm 52 is adapted to contact portions of the pin 24 projecting into the chamber 40 while the second or foreshortened arm 56 is adapted to contact the walls of the chamber 40 and in this way the spring 50 is compressed and electrical contact between the earring 20 and the insert 32 via the post 24 is assured. Generally, the opening 42 is provided with a ledge or base portion 58 of a diameter slightly smaller than that of the opening 44 so as to assure that the resilient plug 46 will not pass into the chamber 40 to interfere with the above indicated spring action.

Figure 5:
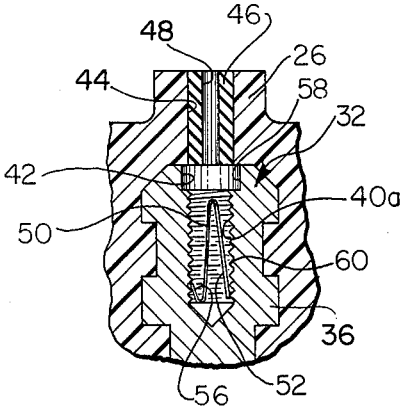
FIG. 5 is a side sectional view similar to FIG. 4 but showing an alternate embodiment of the invention.
Figure 6:
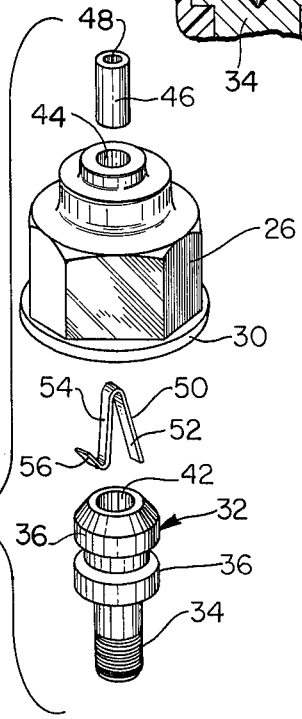
FIG. 6 is an exploded view of the device of the present invention showing the various components thereof prior to assembly.

Turning now to FIG. 5 of the drawing, an alternate embodiment of the invention is disclosed wherein the chamber **40*a* of the insert is provided with threads 60. In such embodiment the shorter leg 56 of the spring 50 positioned in the bottom of the chamber 40 is adapted to engage underside portions of the threads 60 so as to better retain the spring 50 in its position within the chamber 40*a*. Thus in some cases when the earring or post portion 24 thereof is positioned within the chamber 40*a* in contact with the first arm 52 so as to compress the spring, its withdrawal during the completion of the plating or other coating procedure will result in an upward movement being transmitted to the spring 50 and undesirably force such upwardly against the plug 46. However, the provision of the threads 60 prevents such action from occurring and serves to longitudinally position the spring 50 within the chamber 40*a***.

It is accordingly believed that a particularly novel holding device of straightforward design and construction has been provided which achieves the objects of the present invention and overcomes objections of prior art devices. While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A plating rack for electroplating earrings of the type having an ornamental portion and a post extending therefrom and adapted to pass through a pierced ear opening, said rack comprising a plurality of devices adapted to receive and shield the post portion of said earrings and a support having an electrically insulated outer surface adapted for positioning said devices within an electroplating dip tank, each of said devices including a body of electrically insulative material, an electrically conductive insert disposed within said body and adapted to contact said support, said insert having a boss outwardly projecting from one end thereof for receipt in said support so as to provide electrical contact between said insert and said support, said body having an elongated bore extending inwardly thereof, a resilient member having a narrow generally centrally disposed elongated bore adapted to frictionally receive said earring post associated with said elongated bore, said post in free slidable contact with said member so that portions of said post are positioned within said elongated bore and those portions of said post extending into said narrow bore are masked from contact with plating solution, and electrically conductive spring means positioned within said elongated bore and in electrical contact with said insert, said spring means laterally engaging said post for assuring electrical contact between said post and said insert.

2. The device as set forth in claim 1, said spring being a generally S-shaped leaf spring having a first inward centrally disposed arm in contact with said post and a second outward radially disposed arm in contact with said insert.

3. The device as set forth in claim 2, said elongated bore includes radially inwardly extending projections and wherein said second spring arm terminus is adapted to contact under portions of one of said projections so as to prevent upward movement thereof with respect to said chamber.

4. The device as set forth in claim 3 and said second arm being of foreshortened longitudinal extent.

5. The device as set forth in claim 4, said elongated bore being of circular cross section, and said projections being threads.

6. The device as set forth in claim 2, said second arm being of foreshortened longitudinal extent.

7. The device as set forth in claim 1, both said body and said insert having an elongated opening communicating and generally aligned with each other to form said elongated bore, said plug positioned in said body opening.

8. The device as set forth in claim 1, said body terminating in an outwardly extending flange, said insert one end terminating in a threaded boss projecting below said flange, said boss threadably received in said support whereby tightening thereof forces said flange into outer surface engagement with said support.

* * * * *